US005085958A

United States Patent [19]

Jeong

[11] Patent Number: 5,085,958

[45] Date of Patent: Feb. 4, 1992

[54] MANUFACTURING METHOD OF PHOSPHOR FILM OF CATHODE RAY TUBE

[75] Inventor: Su-Min Jeong, Suwon, Rep. of Korea

[73] Assignee: Samsung Electron Devices Co., Ltd., Kyunggi-do, Rep. of Korea

[21] Appl. No.: 574,080

[22] Filed: Aug. 29, 1990

[30] Foreign Application Priority Data

Aug. 30, 1989 [KR] Rep. of Korea ..... 89-12395

[51] Int. Cl.[5] ..... G03C 5/00

[52] U.S. Cl. ..... 430/25; 430/26

[58] Field of Search ..... 430/25, 26

[56] References Cited

U.S. PATENT DOCUMENTS

| | | | |
|---|---|---|---|
| 2,790,107 | 4/1957 | Bradley | 430/26 |
| 3,437,482 | 4/1969 | Yamada et al. | 430/26 |
| 3,856,525 | 12/1974 | Inoue | 430/26 |
| 3,890,151 | 6/1975 | Suzuki et al. | 430/26 |
| 4,271,247 | 6/1981 | Morrell | 430/25 |
| 4,556,620 | 12/1985 | Thompson | 430/26 |

*Primary Examiner*—Hoa Van Le

*Attorney, Agent, or Firm*—Cushman, Darby & Cushman

[57] ABSTRACT

A manufacturing method of phosphor film of a color cathode ray tube comprising the steps of: forming a photoresist layer on the inner surface of panel provided with black matrix; drying the photoresist layer and exposing it to the light to form a predetermined pattern; spraying phosphor powder, in such a manner that the sprayed area is in the form of stripe having shorter width than the length of the sides of the bottom surface of panel and said sprayed area is moved along the vertical direction or the horizontal direction over the bottom surface of said panel; developing the desired phosphor stripe, in such a manner that compressed air or developing water is supplied on the inner surface of the panel coated with phosphor powder. In the method, the occurrence of the variation of the luminance of the screen due to the local variation of the thickness of the phosphor layer, is prevented, thereby achieving high quality image of the cathode ray tube.

2 Claims, 2 Drawing Sheets

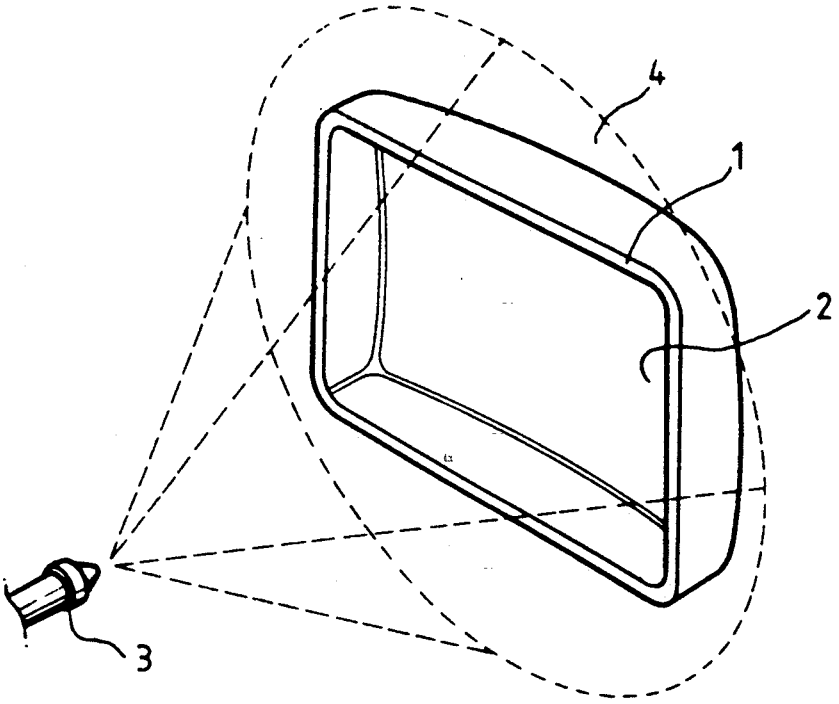
FIG. 1B (Prior Art)
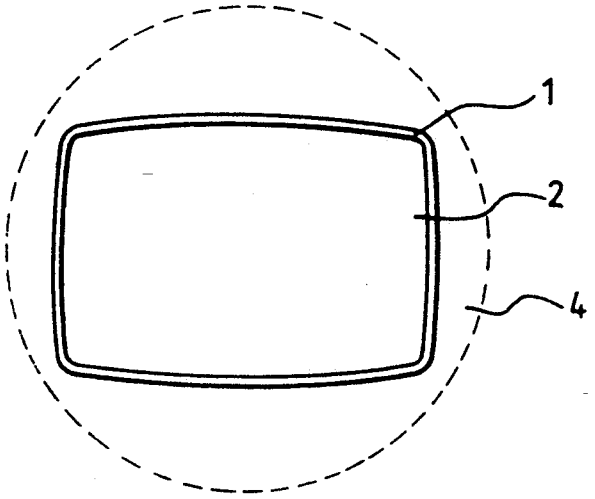

MANUFACTURING METHOD OF PHOSPHOR FILM OF CATHODE RAY TUBE

FIELD OF THE INVENTION

The present invention relates to a manufacturing method of phosphor film of a color cathode ray tube, and more particularly to a manufacturing process of a phosphor film using powdered phosphor.

BACKGROUND OF THE INVENTION

As a general manufacturing method of phosphor film for use in a color cathode ray tube, there are a slurry spread method using a phosphor slurry, and a powder spraying method using phosphor powder. The above described powder spraying method which has been recently developed is classed as a dry dusting method and a wet dusting method, which are disclosed in U.S. Pat. Application Ser. No. 07/238401 filed by this applicant now U.S. Pat. No. 5,002,844. These two types of dusting methods, as explained in detail in the above application, are characterized in that they indirectly form phosphor film by using photoresist layer and phosphor powder, unlike the slurry spread method. Being different from the conventional slurry spread method which can obtain the phosphor stripe having the width about within 30 to 40 μm, these powder spraying methods can obtain smaller width than 10 μm, so that they are very proper for manufacturing a finer phosphor screen. Thus, the above wet dusting method which is generalized as a manufacturing process of phosphor surface of cathode ray tube for industrial use such as a monitor for a computer has merits in having phosphor strip which is finer and has higher color purity than that of the dry process.

Hereinafter, the dry dusting method and the wet dusting method as the powder spraying method will be briefly explained to help the understanding of the present invention which will be explained later.

DRY DUSTING METHOD

The principal processes of the dry dusting method referred as the conventional technique in the above application will be explained as follows.

1) On a whole inner surface of a panel formed with black matrix for absorbing the light via the preceding process, a photoresist layer is formed by uniformly coating liquid photoresist of a predetermined thickness. Here, the liquid photoresist is cohesive and has the characteristic of photolysis. In general, the photoresist comprises polyvinyl alcohol, diazonium salt, surfactant, etc.

2) After said photoresist layer is dried, said photoresist layer is exposed to the light in the form of stripes or dots via an exposure process using the generalized exposure apparatus.

3) On the inner surface of panel provided with the exposed photoresist layer, the phosphor powder is injected to be coated on the whole inner bottom surface 2 of the panel 1 through the injection nozzle 4 as shown in FIG. 1A and FIG. 1B.

4) On the bottom surface 2 of the panel 1 coated with the phosphor powder, the phosphor powder attached to the unexposed portion of the photoresist layer i.e. the phosphor powder attached to the portion which does not represent the adhesion is separated and removed by injecting compressed air of high pressure.

5) The liquid loading agent is added to the phosphor powder layer which has been coated in the form of stripes or dots on the photoresist layer by the compressed air of the high pressure, so that cohesion of the photoresist is removed.

Since the above processes should be carried out for the respective three colors i.e. R, G, and B of phosphor powder, they are repeated three times for a panel.

WET DUSTING METHOD

This wet dusting method which is disclosed in the above application is a new powder spraying method developed by the present applicant. The main processes of the wet dusting method are as follows.

1) On the whole inner surface of the panel provided with the black matrix for absorbing the outside light via the preceding process, photoresist layer is formed. Here, the photoresist layer is insoluble in water when it is exposed to the light and has the characteristic of light cohesion.

2) After drying the photoresist layer, the photoresist layer is exposed to the light in the form of stripes or dots via the exposure process using the generalized exposure apparatus.

3) On the inner surface of the panel provided with the exposed photoresist layer, phosphor powder is injected to be coated on the whole inner bottom surface 2 of the panel 1 through the injection nozzle, as shown in FIG. 1A and FIG. 1B which was referred in the above dry method.

4) Water is supplied on the bottom surface 2 of the panel 1 coated with the phosphor powder and then the unexposed photoresist is dissolved, so that a remaining desired phosphor strip is obtained.

5) The above phosphor stripe is contracted and adhered by supplying boric acid water on the inner surface of the panel.

Since the above processes should be carried out for the respective three colors i.e. R, G, and B of phosphor powder, they are repeated three times for a panel, as in the above-mentioned dry dusting method.

As described above, the phosphor manufacturing process using powder phosphor is classed as a dry dusting method and a wet dusting method, according to the developing process, and the common point of these methods is that the phosphor powder is sprayed to be coated on the inner surface of the panel provided with the photoresist layer. However, as described above, in the conventional method, the predetermined colored phosphor powder, as described above with referring to FIG. 1A and FIG. 1B, is sprayed with a high velocity from the injection nozzle 3 positioned in front of the inner surface of the panel 1, so as to be coated on the surface of the photoresist layer. At this time, the portion 4 sprayed with phosphor powder through the nozzle is in the form of a circular plane, so that the density of the phosphor particles injected by the above method becomes denser at the central part of the panel and thinner in the periphery of the screen. As the result, the above conventional method of spraying the phosphor powder results in the nonuniform thickness of the phosphor film. In addition, the thickness of the central portion of the phosphor film becomes thicker than that of the periphery of the film.

As the result, if phosphor film is manufactured by the above method, the difference of the film thicknesses brings about the non-uniformity of the luminance, so that the image of high quality can not be achieved.

SUMMARY OF THE INVENTION

It is the object of the present invention to provide a manufacturing method of phosphor film of a color cathode ray tube which can prevent the difference of the luminance raised by the non-uniformity of the thickness of the phosphor film, so as to improve the quality of the image in a color cathode ray tube.

To achieve the above object of the present invention, the manufacturing method according to the present invention comprises the steps of:

forming a photoresist layer on the inner surface of panel provided with black matrix;

drying the photoresist layer and exposing it to the light to form a predetermined pattern;

spraying phosphor powder, in such a manner that the sprayed area is in the form of stripe having shorter width than the length of the sides of the bottom surface of panel and said sprayed area is moved along the vertical direction or the horizontal direction over the bottom surface of said panel;

developing the desired phosphor stripe, in such a manner that compressed air or developing water is supplied on the inner surface of the panel coated with phosphor powder.

BRIEF DESCRIPTION OF THE DRAWINGS

The above object and other advantages of the present invention will become more apparent by describing a preferred embodiment of the present invention with reference to the attached drawings, in which:

FIG. 1A and FIG. 1B show a conventional phosphor spraying method wherein the phosphor powder is injected through a nozzle to be coated on the inner surface of a panel, thereby forming a circular sprayed area.

DETAILED DESCRIPTION OF THE INVENTION

The manufacturing method of phosphor film according to the present invention partially includes the conventional manufacturing process. In the manufacturing method according to the present invention, at first a photoresist layer is formed on the inner surface of panel provided with black matrix, and then the photoresist layer is dried and exposed to the light to form a desired pattern. Then, phosphor powder is sprayed over the bottom surface of the panel provided with the exposed photoresist layer. Next, the photoresist layer sprayed with the phosphor powder is developed, so as to obtain the phosphor stripe. In the above developing step, in the case of the dry dusting method, the phosphor stripe is obtained in such a manner that the phosphor powder formed on the unexposed area of photoresist layer is removed by using the compressed air. On the other hand, in the wet dusting method, the desired phosphor stripe are obtained in such a manner that the unexposed portion of the photoresist layer is dissolved (or developed) in water. Then, as the next step, the cohesion of the photoresist is lost by the loading agent in the case of the dry dusting method, or the phosphor stripe is contracted and adhered by using the boric acid water in the case of the wet dusting method.

The characteristic step of the present invention is the step of spraying phosphor powder. The sprayed area is in the form of stripe having shorter width than the length of the sides of the bottom surface of panel and said sprayed area is moved along one side of the panel over the bottom surface of said panel.

The step of spraying phosphor powder will be described in more detail.

Figure 2A:
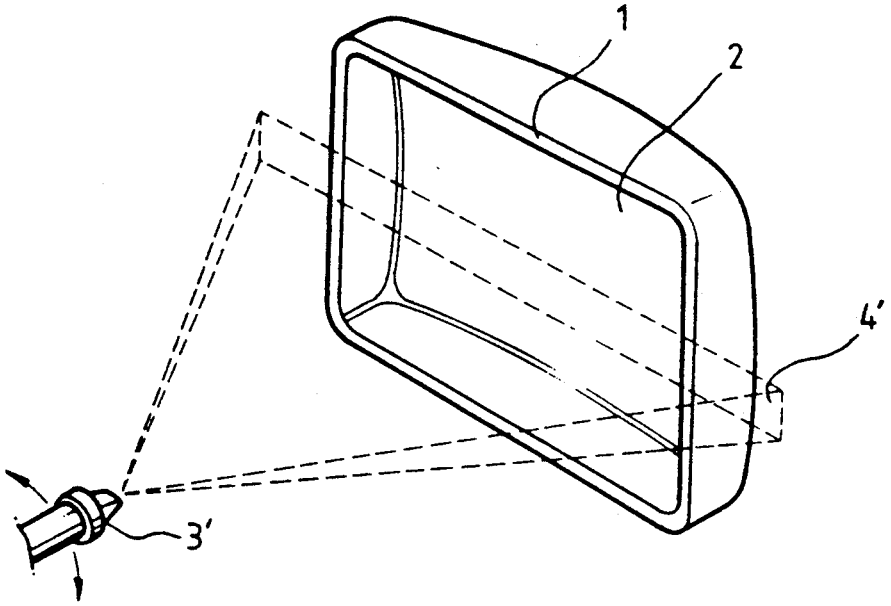
FIG. 2A and FIG. 2B show a phosphor spraying method according to the present invention wherein the phosphor powder is injected to be coated on the inner surface of a panel, thereby forming a repeated stripe type sprayed area.
Figure 2B:
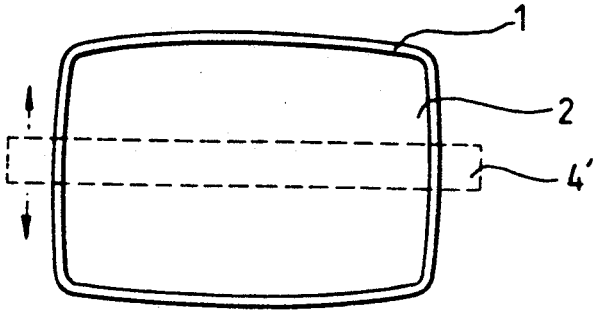

Referring to FIG. 2A and FIG. 2B, the phosphor powder is sprayed through a nozzle 3' which is positioned at a distance from the inner surface 2 of the panel 1. At this time, the area 4', onto which the phosphor powder will be injected, does not have the same dimension as the whole bottom surface 2 of the panel 1, but is in the form of stripe which is a little longer in its length than the longer side of the panel and is much shorter in its width than the shorter side of the panel.

The above sprayed area 4' in the form of stripe formed according to the structure of the nozzle 3', is moved by swinging the nozzle 3' along the shorter sides of the panel so as to cover the whole area of the bottom surface 2 of the panel 1.

When phosphor powder is coated on such spraying area in the form of stripe, the thickness of the phosphor film formed on the bottom surface 2 of the panel becomes uniform throughout the whole bottom surface of the panel. This comes from the fact that, through the process of spraying phosphor powder from the nozzle 3', the phosphor powder is sprayed in a stripe very narrowly along the shorter side of the panel 1 and very widely along the longer side of the panel 1, so that the injecting density of phosphor becomes uniformer over the whole sprayed area 4'. That is, the spreading angle of the phosphor powder is very small along the shorter side of the sprayed area 4' of phosphor powder, so that the variation of the density becomes negligible. Moreover, since the phosphor powder is sprayed very widely along the longer side of the panel, the spreading of the phosphor powder is uniformly carried out, so that the density difference of the phosphor powder at the central portion and the surrounding of the panel is very small.

When phosphor powder is injected at the same time over all surface of the panel having the nozzle fixed, the difference of the densities will certainly occur. However, the manufacturing method of the phosphor film according to the present invention can effectively solve the above problem, so as to form the phosphor film having the uniform thickness. In the present invention, it is preferable to form the width of the sprayed area of the phosphor powder as narrow as possible.

According to the present invention, the phosphor film having very uniform thickness can be obtained, regardless of the dusting method adopted, i.e. a dry dusting method or a wet dusting method. Thus, the occurrence of the variation of the luminance of the screen due to the difference of the thickness of the phosphor layer is prevented, thereby achieving the image of high quality of the cathode ray tube.

What is claimed is:

1. A manufacturing method of phosphor film for use in a color cathode ray tube comprises the steps of:

forming a photoresist layer on the inner surface of a panel provided with black matrix;

drying said photoresist layer and exposing it to the light to form a predetermined pattern;

spraying phosphor powder, in such a manner that a sprayed area is in the form of stripe having shorter width than the length of the sides of the bottom surface of panel and said sprayed area is moved along the vertical direction or the horizontal direction over the bottom surface of said panel;

developing the desired phosphor stripe, in such a manner that compressed air or developing water is supplied on the inner surface of the panel coated with phosphor powder.

2. A manufacturing method of phosphor film of a color cathode ray tube as claimed in claim 1, wherein said sprayed area in the form of stripe is oriented to be in parallel with the longer side of the panel and is moved along the shorter side of the panel.

* * * * *